US006701756B2

(12) United States Patent
Hedegaard

(10) Patent No.: US 6,701,756 B2
(45) Date of Patent: Mar. 9, 2004

(54) METHOD AND MEANS FOR DRYING AND FASTENING OF STRETCHED PELT ON A PELTINGBOARD

(75) Inventor: Jens Hedegaard, Holstebro (DK)

(73) Assignee: Majgaard Invest ApS, Holstebro (DK)

( * ) Notice: Subject to any disclaimer, the term of this patent is extended or adjusted under 35 U.S.C. 154(b) by 0 days.

(21) Appl. No.: 10/204,855

(22) PCT Filed: Feb. 26, 2001

(86) PCT No.: PCT/DK01/00131

§ 371 (c)(1),
(2), (4) Date: Aug. 26, 2002

(87) PCT Pub. No.: WO01/62985

PCT Pub. Date: Aug. 30, 2001

(65) Prior Publication Data

US 2003/0019255 A1 Jan. 30, 2003

(30) Foreign Application Priority Data

Feb. 25, 2000 (DK) ..... 2000 00304
Mar. 24, 2000 (DK) ..... 2000 00505

(51) Int. Cl.[7] ..... C14B 1/00
(52) U.S. Cl. ..... 69/22; 69/23

(58) Field of Search ..... 69/19, 19.1, 19.2, 69/19.3, 22, 23, 27, 28, 33; 38/102.1, 108; 34/103, 448, 509, 615, 621, 236, 239; 223/63

(56) References Cited

U.S. PATENT DOCUMENTS

| | | | | |
|---|---|---|---|---|
| 1,320,223 A | | 10/1919 | Guy | |
| 3,313,038 A | | 4/1967 | Bolz | |
| 4,381,654 A | * | 5/1983 | Baldridge | 69/19.2 |
| 4,389,795 A | * | 6/1983 | Craggs et al. | 34/103 |

FOREIGN PATENT DOCUMENTS

| | | |
|---|---|---|
| DK | 169525 B1 | 11/1991 |
| DK | 172960 B1 | 10/1999 |
| GB | 2211203 A | 6/1989 |
| WO | WO 82/03634 A1 | 10/1982 |
| WO | WO 86/00091 A1 | 2/1986 |

* cited by examiner

*Primary Examiner*—Gary L. Welch
(74) *Attorney, Agent, or Firm*—Nixon & Peabody LLP; David S. Safran

(57) ABSTRACT

In the process of manufacturing furs, the pelt (6) is dried on a peltingboard (2), where it is stretched to an optimum length and fastened to the board by slipping a sleeve-like device (8) over the pelt so tightly that it stops the pelt from sliding back from it tightened position.

16 Claims, 7 Drawing Sheets

METHOD AND MEANS FOR DRYING AND FASTENING OF STRETCHED PELT ON A PELTINGBOARD

Figure 1:
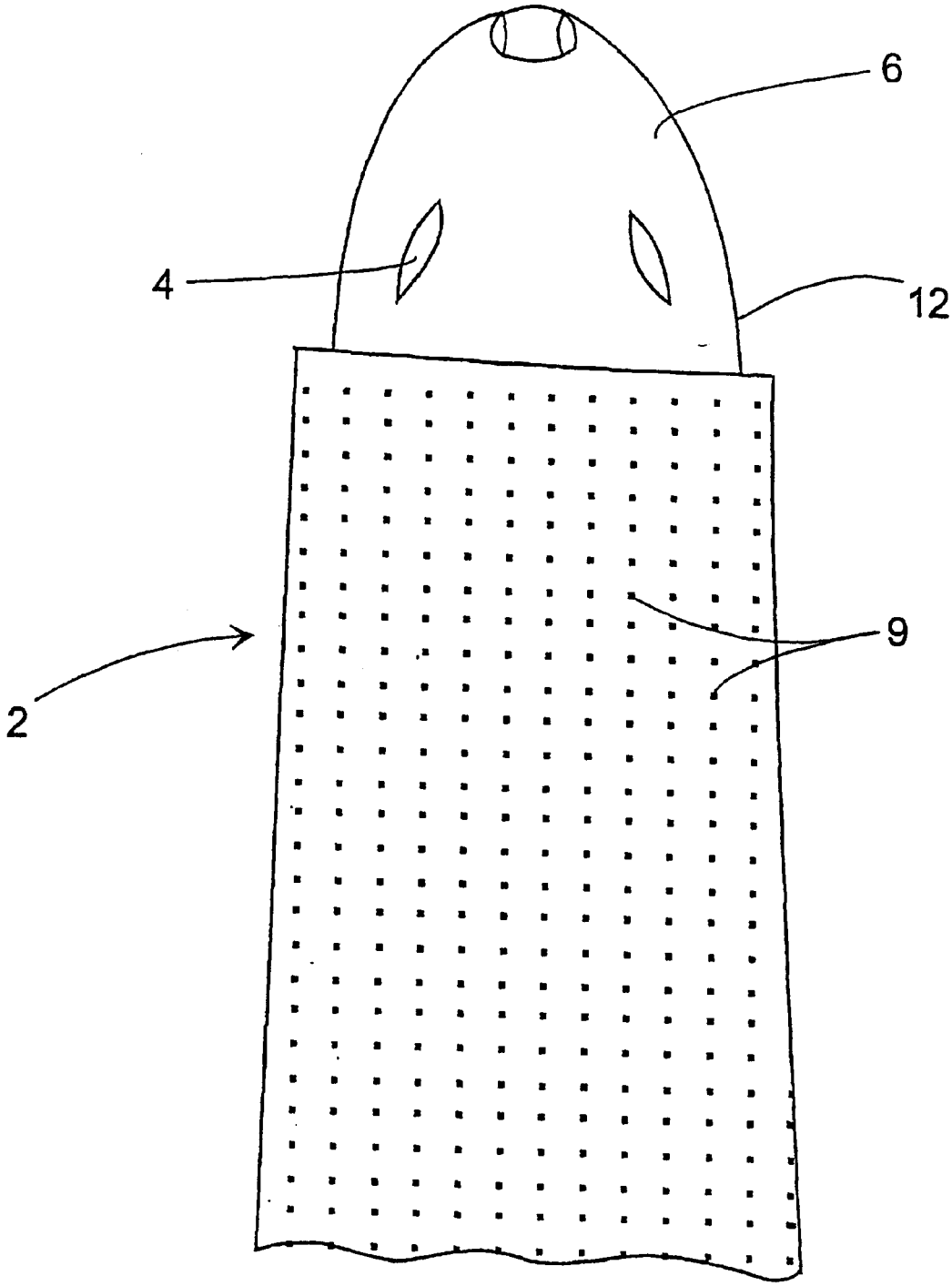

The present invention relates to a method and means for fastening of stretched pelts on pelt boards during drying, namely mink pelts and fox pelts, and means for use in the execution of the method. The invention also concerns a method by which it is possible to avoid drying-out of the fur side of the pelt in connection with the drying process.

In the drying of, for example, mink and fox pelts (in the following both referred to as pelts), after the skinning and the scraping of the layer of fat from the grain side of the pelt, the pelts are stretched on a pelt board which is often first provided with a fat-absorbing material, for example a bag made of fat-absorbing paper, a so-called pelt-board bag, with the object that during the drying, the fat remaining on the grain side of the pelt will be drawn into the paper and hereby be removed from the pelt.

In the following, a stretched and fastened pelt is thus to be understood as a pelt drawn onto a pelt board, and stretched and fastened in this position on the pelt board. In certain cases, before the pelt is mounted on the pelt board, the board can be provided with a bag made of a fat-absorbing material, for example in the form of a so-called pelt-board bag, which will thus lie between the pelt board and the grain side of the pelt.

A traditional pelt board can typically be described as being a flat piece of wood with a first and a second front surface, and first and second side surfaces, the breadth of which is considerably less than the breadth of the front surfaces, and where the one end of which (the foot end) is cut off at right-angles to the longitudinal axis of the pelt board, and the breadth of which decreases gradually towards a pointed but rounded-off end part (the fore-end, the nose end), and where the pelt board has a slot lying symmetrically around the longitudinal axis of the board, extending between a point close to the pointed end part and at least over a half of the length of the pelt board.

Distinction is made between male pelt boards intended for use in connection with pelts from male animals, which are normally larger than those of female animals, and female pelt boards which are both shorter and narrower than the male pelt boards. Near the foot end, the male pelt boards also comprise a part where the first and second side surfaces extend in a parallel manner, whereas the breadth of the female pelt boards decreases along the whole of the length between the foot of the board and the pointed but rounded-off end part (the fore-end, the nose end).

The commonly-known drying process which is used for the drying of pelts presents the problem that the fur side of the pelt is dried out to such a degree that this requires a pre-processing in order to minimise the damage to the natural surface of the pelt, so that the fur side of the dried pelt retains its natural, silky surface to the greatest possible extent. This pre-processing, which is quite labour-demanding and is therefore expensive, consists of handling the pelt in a brushing machine with brushes of horse hair, where the pelts are led through two rotating brushes which run in a water bath, whereby water is transferred to the pelt, and the fur on the pelt is laid down in the same direction, whereby the drying-out of the pelt is reduced. However, the preprocessing suffers the disadvantage that the mechanical influence on the fur in combination with the water results in a "washing-off" of the thin, natural film of fat which nature provides on the individual hairs and which contribute towards giving the fur its silky appearance, the result being that the silky lustre of the pelt is not optimal after the drying.

In the mounting and fastening of pelts on pelt boards before the pelt is dried, a stretching of the pelt is carried out. The stretching is often effected mechanically in order to provide pelts of greatest length (which fetch the highest prices at the fur auction), and in order to retain the pelt in the stretched-out position on the pelt board during the subsequent drying, the pelt is fastened to the board with securing means, for example staples or clips which are shot in manually/mechanically, and which penetrate the pelt. Use is made of 8–10 clips per pelt, which thus leave 16–20 holes in the dried pelt.

During the drying process, air is blow into the pelt board, and this air is diffused via small holes in the walls of the pelt-board bag out to the inner side of the pelt 15' and dries the pelt.

After the drying, the clips are removed and thereafter the pelt is removed from the pelt board, which is often effected mechanically, and as a consequence of the stretching of the pelt, elongated holes resulting from the clips are often left in the pelt, which means that it is not possible to utilise the whole of the dried pelt, in that 2–3 cm of the pelt where this is broadest (and the most valuable) is ruined. Sometimes, the mechanical removal of the clips similarly results in damage to the pelts. All in all, it must be ascertained that the method which is most predominant in connection with the stretching and fastening of pelts on pelt boards during the drying process results in damage to the most valuable part of the pelts. There has long been a desire to be able to avoid this damaging of the pelts during the drying process, but there has not yet been developed a suitable and better fastening technique.

With the invention, the possibility has been realised of being able to render the pre-processing of the pelts superfluous after the stretching and fastening by drawing a sleeve over and around the pelt board with the pelt from the nose end of the pelt board, in that the internal side walls of the sleeve are thus in contact with the fur side of the pelt.

It is hereby achieved that the hairs on the fur side of the pelt are oriented in the same direction, in that these are swept with a parallel-oriented movement in the drawing of the sleeve over the pelt board with the pelt. Moreover, a drying-out of the hairs is avoided without having to effect any pre-processing with rotating brushes and water, which means that the natural layer of fat on the fur is retained, and the pelt is given a more shiny and silky surface. Also, the wastage of water in the drying plant is avoided. Moreover, the forelegs come to lie in a better manner under the pelt, and it is possible to touch the whole of the surface in connection with the handling of the pelts when these are hung up and taken down in the drying plant, in that the hairs of the pelt do not "break" when touched. Furthermore, the pelts are protected against becoming dirty.

A sleeve for the execution of the method according to the invention can be configured as a bag item moulded in one part in thin foil.

In the following, the sleeve for use in the execution of the invention will be referred to as a bag item.

It is preferred, however, without renouncing other configuration, that the bag item be made of a sheet of material which is of such a format that when two opposing sides are assembled, it is suitable for drawing over and around a pelt board on which a pelt has been stretched and fastened in this position, and with a length which approximately corresponds to the length of the stretched pelt, preferably measured between the chin part of the pelt and the lower edge of the back.

Moreover, it is preferred that the bag item is substantially of a shape which corresponds to the fashion of the pelt board with the stretched-out pelt. It is hereby achieved that the load on the fur side of the pelt is more or less uniform.

With the view to providing the possibility of effecting an expedient entry for the introduction of pipes for the blowing-in of air, the bag item can consist of a bag element with a sleeve-like conical shape, i.e. where both ends are open, and where the opening nearest to the nose end of the pelt board is smaller than the opening at the opposite end of the bag nearest to the foot of the board.

With the view to ensuring a certain diffusion of moist air, which stems from the drying of the pelt, through the bag enclosure, the walls of the bag item can be perforated. There is hereby ensured a certain transmission of moisture during the drying process, without any drying-out of the pelt fur taking place.

With the view to being able to exercise the method in connection with pelt boards which are substantially rectangular in shape, the bag item can be configured with parallel sides.

The above method and bag item for use in connection with the drying of pelts stretched and fastened on pelt boards, has thus led to not inconsiderable savings in work operations with the view of being able to obtain beautiful pelts, while retaining their natural, silky appearance after the drying, without having to carry out time-demanding and herewith costly pre-processing of the stretched and fastened pelts. Holes made by the penetration of clips etc. will still, however, continue to be left in the pelt which are fastened in the stretched-out position.

However, a further development of the above-mentioned bag item has led to an equally advantageous invention concerning the fastening of the pelt in the stretched-out position on pelt boards of the kind disclosed.

With the invention, it has thus been further realised that the fastening of pelts in the stretched-out position is possible by a method where, after the mounting of the pelt on the pelt board, a sleeve (bag item) of conical shape, corresponding to the board with the stretched-out pelt, is drawn over and around the pelt, in that said bag item is drawn over the pelt and the board from the nose end of the pelt, after which the pelt on the board is stretched to an optimal stretch length for the relevant pelt, while at the same time the bag is pulled down over the pelt until it makes tight contact with the fur side of the pelt, and finally the traction on the pelt is slackened.

It is hereby achieved that the pelt is locked firmly on the pelt board in the stretched-out position between the pelt-board bag and the overdrawn bag, in that the elastic effect from the fur on the pelt, in combination with the conical profile of the pelt board and the pelt, will give rise to a pressure effect directed towards the board which is sufficient to render the use of fastening clips completely superfluous. This means that there are no holes left in the pelt by clips or the like after the fastening and stretching of the pelts, which makes the pelts particularly attractive. What is thus involved is nothing less than a revolutionary invention in connection with the process of fastening and stretching of pelts on pelt boards, in that the method disclosed permits full utilisation of the most valuable parts of the pelts (the lowermost part of the back) which, as a consequence of the holes, it has hitherto been necessary to cut away before use of the pelts as furs.

In addition to the above-mentioned advantages of the invention, it can also be added that in comparison with the currently-used method, the present invention offers a saving in work operations connected with the fastening of pelts on pelt boards, in that it will no longer be necessary to use clips or staples or similar penetrating fastening means. Furthermore, the work operations connected with the removal of said fastening means after the drying of the pelts is concluded are also dispensed with, during which operations damages to the pelt often arise. Finally, it can be mentioned that with the use of the method, the pelt boards themselves are given a considerably longer lifetime, in that it is no longer necessary to shoot clips or the like into the wood of which the pelt board is made.

It will be obvious that with the method according to the invention the same advantages will also be achieved as already mentioned concerning the protection of the pelt fur against drying-out during the drying process for the fastened and stretched pelts.

A bag item for the execution of the method of fastening stretched pelts on pelt boards can with advantage consist of a bag-item with a sleeve-formed/conical shape, the length of which corresponds substantially to the length of the pelt stretched on the board, preferably measured from the jaw part to the lower edge of the back of the pelt.

It has proved to be advantageous from the point of view of production technique that the bag item is made of a sheet of material with a format which, after the joining together of two opposite sides, forms a sleeve-shaped/conical fashion for surrounding a pelt board on which a pelt is mounted, and where the length of said sheet of material corresponds substantially to the length of the pelt stretched-out on the board, preferably measured from the jaw part to the lower edge of the back of the pelt.

It is hereby achieved that the most important and valuable parts of the fur are covered during the drying, so that the fur side does not dry out.

With the view to ensuring a certain diffusion of moist air through the enclosure bag, which air stems from the drying of the grain side of the pelt, the sheet of material can be perforated. There is hereby ensured a certain transmission of moisture during the drying process, without giving rise to a drying-out of the fur.

With the view to being able to use the enclosure bags in connection with pelt boards which are substantially rectangular in shape, the enclosure bags can be configured with parallel sides.

With the view to being able to use the enclosure bags in connection with pelt boards which extend in a substantially conical manner, the bags can be conical in shape, corresponding to the pelt board with the stretched-out pelt. With the view to being able to increase the pressure between the enclosure bag and the pelt board bag, the enclosure bag can consist of a sheet of elastic material.

In a particularly preferred embodiment of the enclosure bag, the sheet of material consists of a piece of paper.

Figure 2:
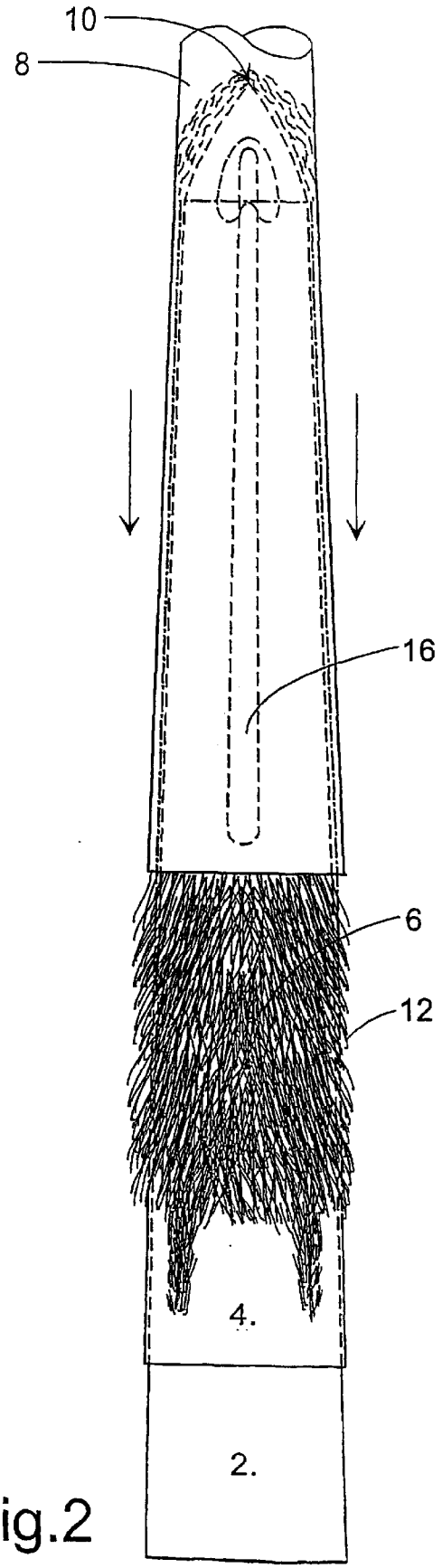
Figure 3:
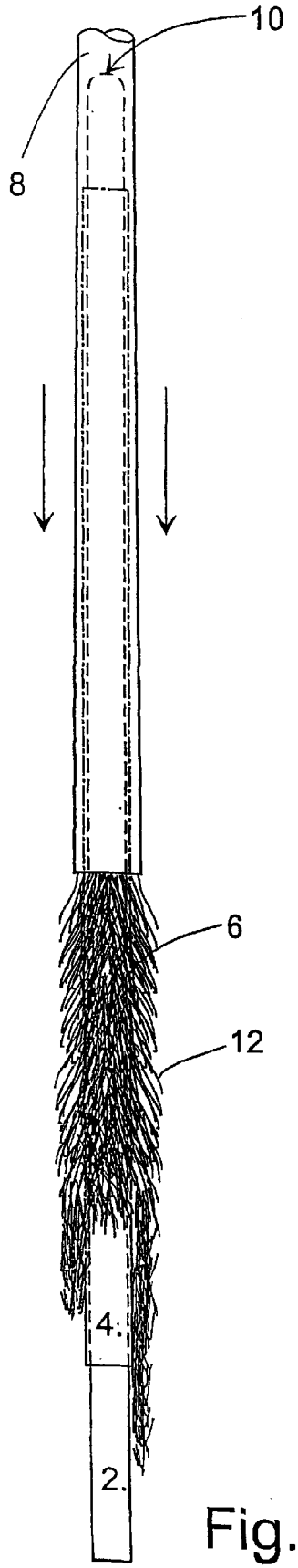
Figure 4:
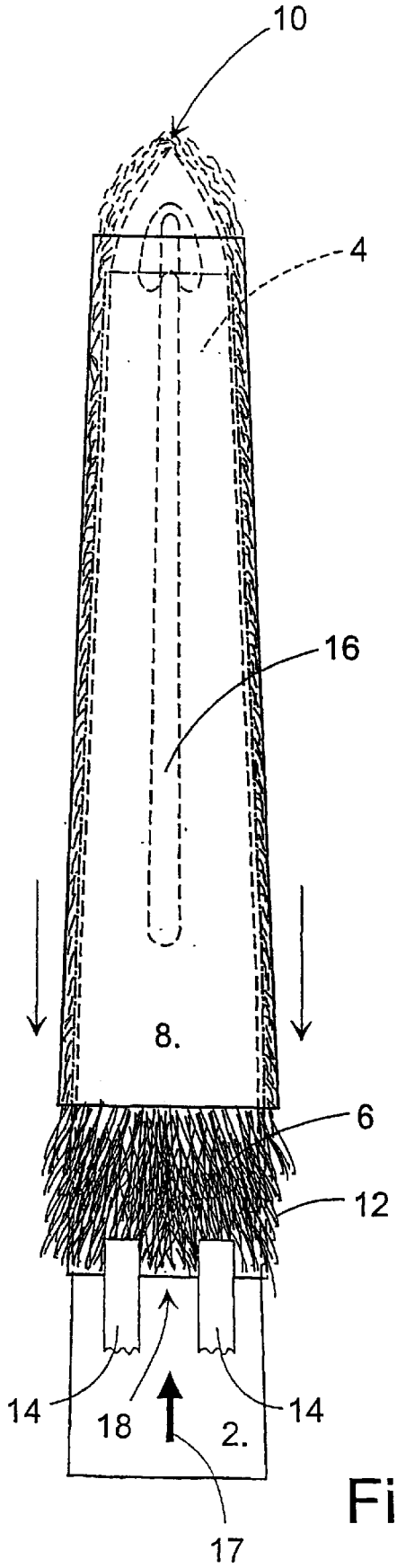
Figure 5:
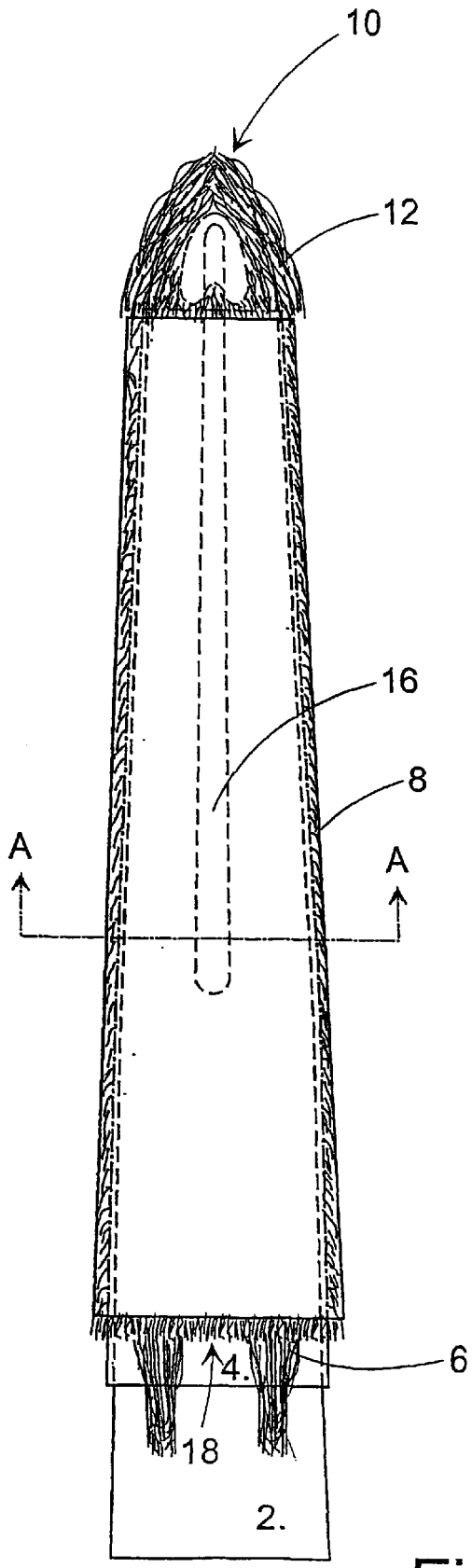
Figure 6:
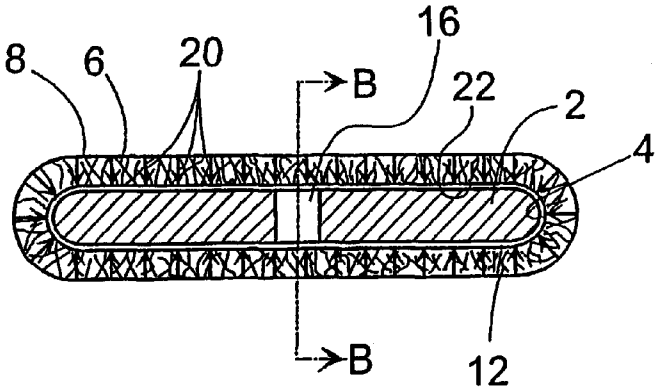
Figure 7:
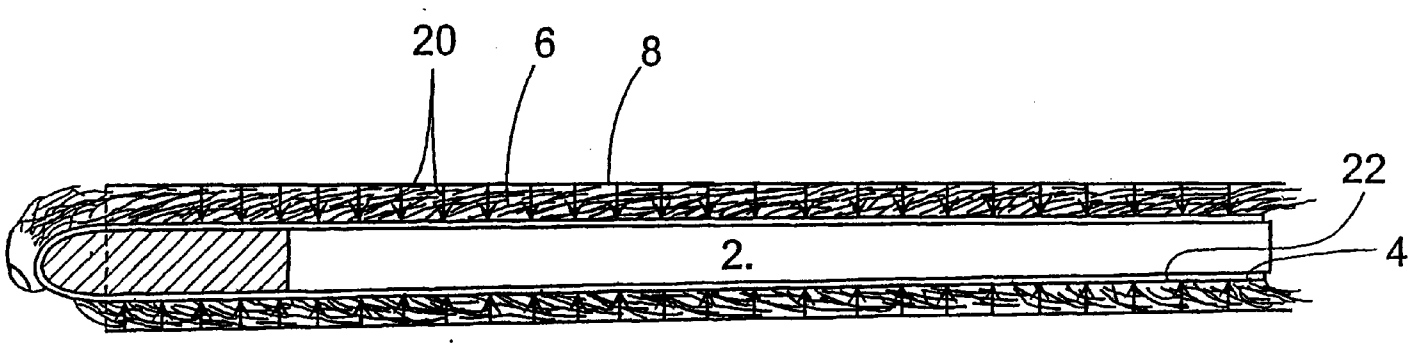
Figure 8:
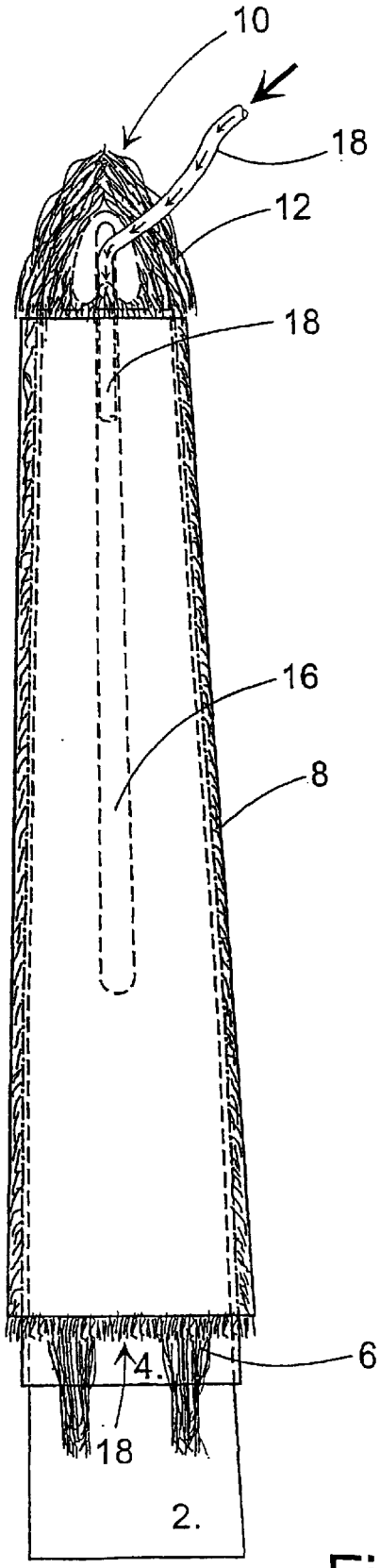
Figure 9:
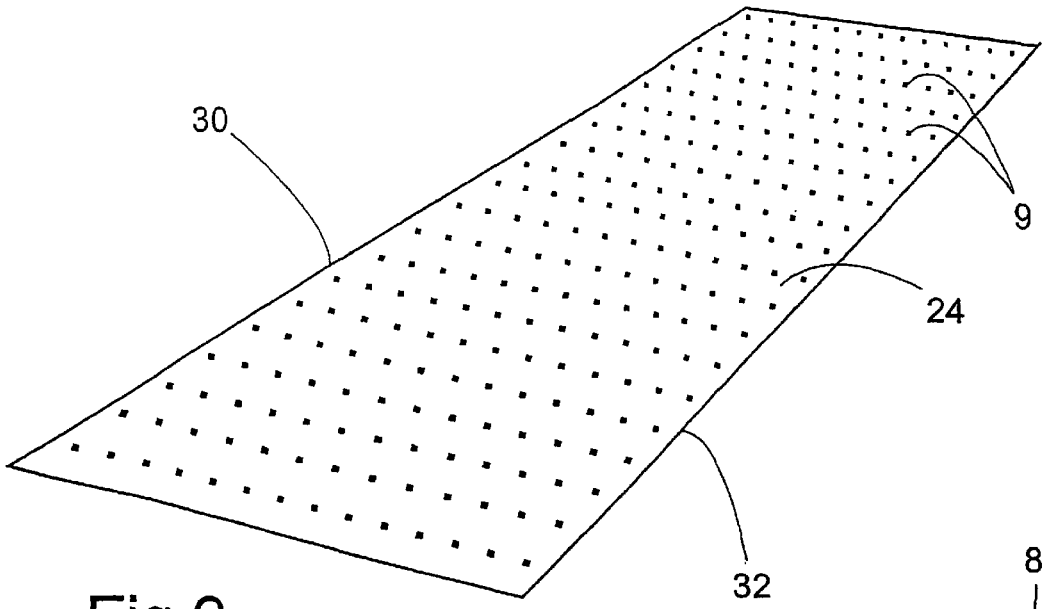
Figure 10:
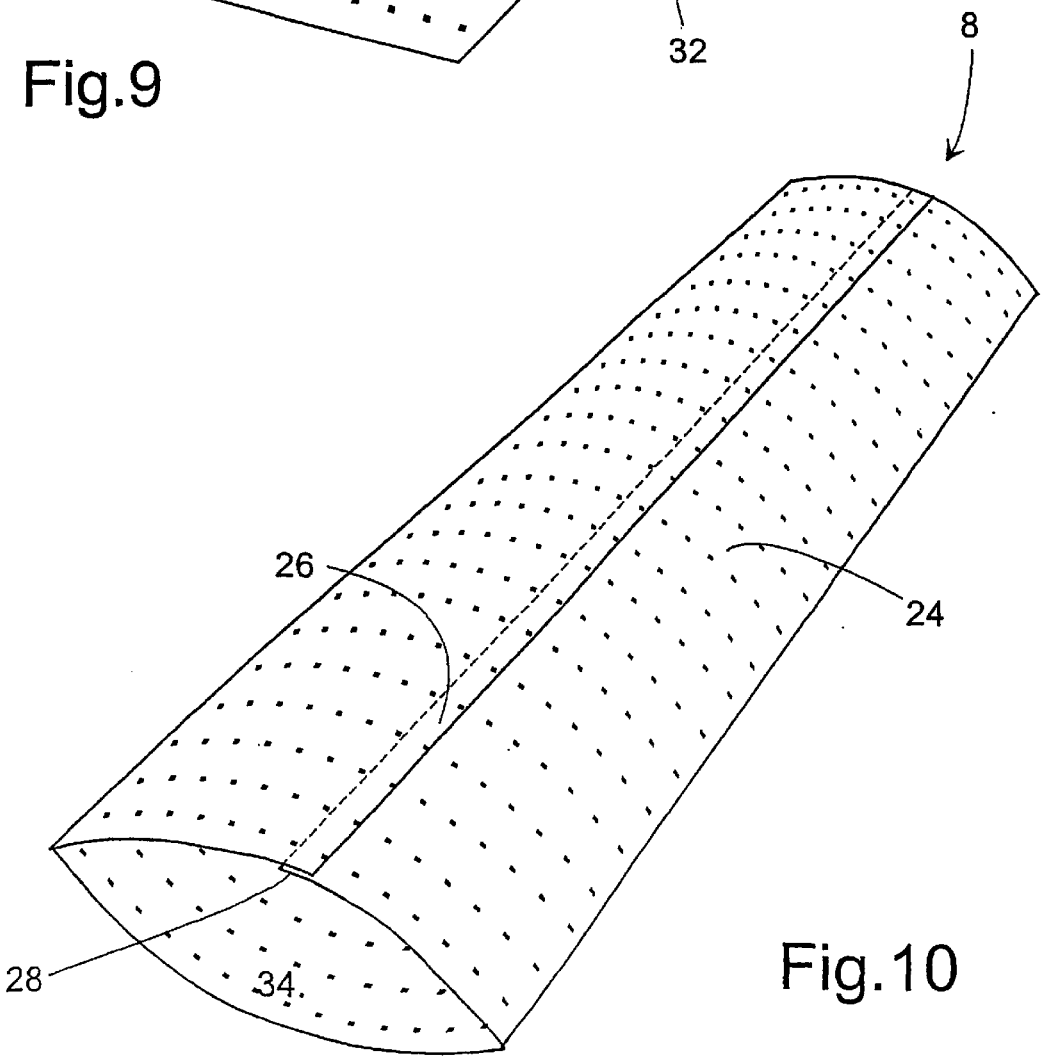

In the following, the invention will be explained in more detail with reference to the drawing, where FIG. 1 is a plan view of the front end of a pelt board with pelt-board bag on which a pelt is stretched, and over which a sleeve (bag item) according to the invention has been drawn, FIG. 2 is a view of the rear side of a pelt board with pelt-board bag, on which a pelt is mounted and shown during the drawing-on of a bag item, FIG. 3 is a side view of that shown in FIG. 2, FIG. 4 is a rear view of the bag item during displacement to the fastening position for the stretched-out pelt mounted on the pelt board, FIG. 5 shows the same as in FIG. 4, but where the bag item is brought into the holding position, where the pelt is fastened on the pelt board in the stretched-out position, FIG. 6 is a cross-sectional view along the line A—A in FIG. 5, FIG. 7 is a side section view along the line B—B in FIG. 6, FIG. 8 shows the pelt fastened and stretched according to the invention during drying, FIG. 9 shows a sheet of material for the production of a bag item according to the invention, and FIG. 10 shows the sheet of material shown in FIG. 9, but with opposite long sides glued together so that it forms a bag item for the execution of the method according to the invention.

In FIG. 1 is seen the front end of a pelt board 2 over which a pelt-board bag 4 has been drawn (see also FIG. 2), and over which there is drawn a mink pelt 6, and over and around this a bag item 8 which in the shown embodiment is made of paper with perforations 9 as indicated in FIG. 1.

FIGS. 2 and 3 show the pelt board 2 with pelt-board bag 4 on which a pelt 6 has been mounted, during the drawing-on of a sleeve-shaped/conical bag item 8. The bag item is drawn over the pelt 6 mounted on the board 2 from the nose end 10 of the board, whereby the hairs 12 on the pelt are swept in a parallel manner with the same orientation as given to them naturally.

FIG. 4 shows the pelt 6 on the pelt board 2 during the stretching out to the ideal length for the relevant size of pelt, where with gripping means 14 (not shown) the pelt 6 is fastened during a displacement of the pelt board 2 in the direction of the arrow 17, while at the same time the bag item 8 is displaced downwards towards the lower edge 18 of the pelt 6.

In FIG. 5 the pelt 6 is seen fully stretched-out on the pelt board 2, and fastened in this position by the bag item 8, ready for drying by the introduction of an air hose 18 in the longitudinal slot opening 16 in the pelt board, as will appear from FIG. 8.

FIG. 6, which is a sectional view along the line AA in FIG. 5, shows the pelt board surrounded by the pelt-board bag 4, a pelt 6 and a bag item 8 according to the present invention. As indicated by the arrows 20, the pelt 6 is pressed against the pelt-board bag 4 and the pelt board 2 as a consequence of the presence of the bag item 8, which is drawn over and around the pelt 6 and presses down the fur 12 on the pelt, the result being that the pelt remains in its stretched-out position during the whole of the drying process. During the drying of the grain side 22 of the pelt, air is blown in via a hose 18 placed in the opening 16 in the pelt board 2, cf. FIG. 8.

In FIG. 7 it is shown how the bag item 8 drawn over the pelt 6 holds the fur 14 in place during the drying of the pelt, and also how the bag item 8 presses against the fur 14 on the pelt 6, so that the grain side 22 of the pelt 6 is pressed towards the pelt-board bag 4. There hereby arises so great a friction between the grain side of the pelt and the pelt-board bag 4 and the pelt board 2, that it is sufficient to hold the pelt 6 stretched out without the use of penetrating fastening means which are otherwise passed through the pelt and anchored in the pelt board. Out of regard for clarity, the perforations 9 in the paper of which the bag item 8 in the shown embodiment is made are not shown in the FIGS. 2–8.

FIG. 9 shows a preferred embodiment of a sheet of material 24 with a basically trapezoidal shape, and which is provided with perforations 9 for the production of a bag item 8.

FIG. 10 shows a bag item 8 made of the sheet of material 24 shown in FIG. 9, where a gluing 26 is effected in an overlap 28 along the longest opposing sides 30, 32 of the sheet of material. There is hereby formed a sleeve (bag item) 8 with a conical-cylindrical cavity 34, so that upon being drawn over from the nose end 10 of the pelt, and a subsequent displacement after the pelt is stretched out on the pelt board 2, the sleeve (bag item) can be displaced to a locking position in which the pelt is pressed against the pelt board 2 by the elastic effect of the fur.

By the presence of the bag item over and around the fur side of the pelt, a certain moistness is retained in the fur during and after the drying of the pelt, and this results in the fur retaining its lustre without the need for preprocessing and possibly subsequent processing.

In conclusion, it can be said that the use of the method and the bag item according to the invention provides possibilities for hitherto-unknown rationalisation advantages and increased earnings within a very tradition-bound industry which is very sensitive to market fluctuations, and which subsequently has need for the implementation of a rationalisation of operations in order to survive. Consequently, in the execution of the method and the use of the sleeve/bag item according to the invention, the possibility is provided of achieving a better utilisation of the most valuable parts of the pelt, and which at the same time enables three working operations to be dispensed with, namely the water treatment, the insertion of securing clips or the like and the removal of these after the drying.

What is claimed is:

1. Method of drying of a fur side of pelts, comprising the steps of:

mounting a pelt stretched-out on a pelt board and fastening the pelt in position on the pelt board;

drawing a sleeve or bag item over and around the pelt board and the pelt from a nose end of the pelt board until internal side walls of the sleeve or bag are brought into tight contact with a fur side of the pelt; and drying the pelt on the pelt board, the sleeve or bag preventing drying out of the fur side.

2. Sleeve and board combination for drying of a fur side of pelts comprising a tubular bag item formed of a molded one-piece thin foil and a pelt board for mounting of a pelt to be dried stretched out thereon, said sleeve being sized and shaped for being drawn over and around the pelt board and the pelt from a nose end of the pelt board so as to bring internal side walls of the sleeve into contact with the fur side of the pelt.

3. Sleeve and board combination according to claim 2, wherein the bag item is formed of a sheet of material which has been joined at two opposite sides, and with a length which corresponds approximately to the length of the stretched-out pelt.

4. Sleeve and board combination according to claim 3, wherein said length is measured between a jaw part and a lower edge of a back of the pelt.

5. Sleeve and board combination according to claim 3, wherein the bag item is of a shape which corresponds to the shape of the pelt board with the stretched-out pelt mounted thereon.

6. Sleeve and board combination according to claim 3, wherein the bag item comprises a bag element with a sleeve-like conical shape that is open at opposite ends, and one open end being smaller than the opposite end.

7. Sleeve and board combination according to claim 3, wherein the sleeve has perforations.

8. Sleeve and board combination according to claim 3, wherein the sleeve has parallel sides.

9. Sleeve and board combination according to claim 3, wherein said sheet of is made of an elastic material.

10. Sleeve and board combination according to claim 3, wherein said sheet of is made of a paper material.

11. Sleeve and board combination according to claim 10, wherein said sheet is perforated.

12. Sleeve and board combination according to claim 10, wherein the sleeve has perforations and has overlapping parallel longitudinal sides of a trapezoidal shape, a longitudinal edge of one side being adhered to a longitudinal edge of the other side.

13. Method for the fastening of a pelt stretched out on a pelt board for drying, comprising the steps of disposing a fur pelt on a pelt board, drawing a sleeve of conical shape of over the board and the pelt disposed thereon, applying traction to stretch the pelt, drawing the sleeve down into tight contact with a fur side of the pelt to prevent drying out of the pelt during drying, and slackening the traction on the pelt, said pelt being held on said pelt board in a stretched condition by said sleeve.

14. Method according to claim 13, wherein said pelt is one of a mink pelt and a fox pelt.

15. Method according to claim 14, wherein, after said drawing steps have been performed, said sleeve extends from about a jaw part of the pelt to about a lower edge of aback of the pelt.

16. Method according to claim 13, wherein said drawing steps are performed from a head end toward a tail end of the pelt.

* * * * *